US011841201B2

(12) United States Patent
Wutte

(10) Patent No.: US 11,841,201 B2
(45) Date of Patent: Dec. 12, 2023

(54) BARREL UNIT FOR A FIREARM

(71) Applicant: GLOCK TECHNOLOGY GMBH, Ferlach (AT)

(72) Inventor: Andreas Wutte, Ferlach (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 111 days.

(21) Appl. No.: 17/753,945

(22) PCT Filed: Sep. 28, 2020

(86) PCT No.: PCT/EP2020/077084
§ 371 (c)(1),
(2) Date: Mar. 18, 2022

(87) PCT Pub. No.: WO2021/063876
PCT Pub. Date: Apr. 8, 2021

(65) Prior Publication Data

US 2022/0341695 A1 Oct. 27, 2022

(30) Foreign Application Priority Data

Oct. 4, 2019 (EP) ..... 19201455

(51) Int. Cl.
*F41A 21/48* (2006.01)

(52) U.S. Cl.
CPC ..... *F41A 21/484* (2013.01); *F41A 21/487* (2013.01)

(58) Field of Classification Search
CPC ..... F41A 21/484; F41A 21/48; F41A 21/487; F41A 21/481
USPC ..... 42/75.02, 75.01
See application file for complete search history.

(56) References Cited

U.S. PATENT DOCUMENTS

| | | | | |
|---|---|---|---|---|
| 7,823,314 | B1 * | 11/2010 | Wheatley | F41A 21/484 89/14.4 |
| 9,383,154 | B2 * | 7/2016 | Stone | F41A 21/28 |
| 10,704,852 | B2 * | 7/2020 | Michut | F41A 11/02 |
| 11,333,460 | B2 * | 5/2022 | Wutte | F41A 21/481 |
| 2010/0281742 | A1 * | 11/2010 | Barrett | F41A 21/487 42/75.02 |

FOREIGN PATENT DOCUMENTS

| | | | |
|---|---|---|---|
| DE | 102006022622 | A1 | 11/2007 |
| EP | 1750079 | A1 | 2/2007 |
| GB | 268996 | A | 4/1927 |
| GB | 1200850 | A | 8/1970 |

OTHER PUBLICATIONS

EP Search Report Intl. Appl. No. PCT/EP2020/077084, dated Dec. 9, 2020.

* cited by examiner

*Primary Examiner* — Reginald S Tillman, Jr.
(74) *Attorney, Agent, or Firm* — Raven Patents, LLC; Anton E. Skaugset

(57) ABSTRACT

A barrel unit for a firearm, including a barrel with a barrel axis, muzzle and a barrel end opposite the muzzle, on which at least two barrel lugs are formed, and a barrel extension with a barrel receptacle and a first end and a second end, wherein inwardly extending locking lugs are formed on the first end, to work together with a bolt, and inwardly extending barrel locking lugs are formed closer to the second end than the locking lugs. A barrel cam on the outer surface cooperates with a cam lug arranged on the barrel extension to fix the barrel in a predefined end position.

22 Claims, 11 Drawing Sheets

BARREL UNIT FOR A FIREARM

TECHNICAL FIELD

The present disclosure relates to a barrel unit for a firearm, comprising a barrel and a barrel extension which are detachably connected to each other and subsequently to the receiver, primarily the upper receiver part, and the connection of the two parts.

BACKGROUND

As used herein, the term firearm is understood as including, without limitation, handguns such as pistols, as well as long guns such as rifles, including carbines, and repeating rifles.

In recent years, military, law enforcement, and civilian users have increasingly demanded that it should be possible to exchange the barrel of a rifle without great effort. This can be done, for example, in order to be able to use barrels of different lengths, or barrels with different calibers, wherein the barrel axis/bore maintains its position in the receiver (upper part) for each caliber. In the latter case, optional changes may have to be made in the lower receiver part, but such changes are not part of the present disclosure.

Accordingly, modern firearms often have a barrel unit which comprises at least the barrel and the barrel extension. The barrel unit in turn can be connected to the receiver by means of, for example, a barrel nut, a clamping mechanism, etc.

A common variant for coupling a barrel with a barrel extension is the use of threaded connections. The barrel has an external thread at the end of the barrel remote from the muzzle, and the barrel extension likewise has a corresponding internal thread. For coupling the two, the barrel can simply be screwed into the barrel extension. The barrel can be secured against rotation by means of cross bolts or grub screws, etc. Such a coupling of the barrel with the barrel extension can be found, for example, in rifles of the M4/M16/AR15 type.

Another known variant for coupling the barrel and the barrel extension utilizes the principle of locking lugs, as is known, for example, from rotating bolts. Corresponding barrel lugs are formed on the outside in the circumferential direction, and the barrel extension has identical and opposite barrel locking lugs facing inwards. After the barrel has been inserted into the barrel extension, the barrel is rotated, thereby causing the barrel lugs and barrel locking lugs to come into an overlapping position when viewed in the axial direction. The barrel and barrel extension are thus secured in the axial direction. The barrel can be secured against rotation by means of a cross bolt or grub screw, etc.

An example of a firearm that utilizes this locking principle is the Steyr AUG rifle, which is designed to have the barrel extension as part of the receiver/breech. However, this securing takes place via a transverse bolt located in the receiver, which some users find difficult to use, especially in bad weather.

The previously known arrangements for attaching the barrel to a receiver are more or less well-suited for positioning the barrel in a predefined position with repeatable accuracy in the barrel extension, and thus relative to the receiver of the firearm.

What is needed, however, is a barrel unit with a mechanically strong connection, comprising the barrel and the barrel extension. Preferably, such a barrel unit would enable users to change a barrel in a way that can be carried out as simply as possible and without tools. Also desirable is a barrel unit that can achieve an installation situation in which the barrel is secured against rotation in the installed condition. Furthermore, it is seen as-advantageous to enable the barrel to be positioned with repeatable accuracy relative to the receiver. Additionally, such a barrel unit should lend itself to simplified, and thus cost-reduced, production methods.

SUMMARY

The present disclosure is directed to barrel units for firearms, the barrel units including a barrel having a barrel axis, a muzzle, a barrel end opposite the muzzle, and at least two barrel lugs formed on the barrel end. The barrel unit further includes a barrel extension having a barrel receptacle, the barrel extension having a first end and a second end; where a plurality of inwardly extending locking lugs is formed on the first end of the barrel extension, the locking lugs being configured to work together with a bolt, and a plurality of inwardly extending barrel locking lugs formed on the barrel extension, the barrel locking lugs being formed closer to the second end than the inwardly extending locking lugs. The barrel has a cam on an outer surface that is configured to cooperate with a cam lug arranged on the barrel extension, the cam having a first portion and a second portion, the first portion being formed beginning at the end of the barrel and extending parallel to the barrel axis, and the second portion being at least partially formed in a circumferential direction around the barrel axis. The second portion of the cam has a locking surface that is complementary in shape to the cam lug, such that the cam lug and/or the locking surface are configured to be preloaded against each other in a radial direction to fix the barrel in a predefined end position.

BRIEF DESCRIPTION OF THE DRAWINGS

The barrel unit of the present disclosure is explained in more detail below with reference to the drawings, wherein.

DETAILED DESCRIPTION

Figure 1:
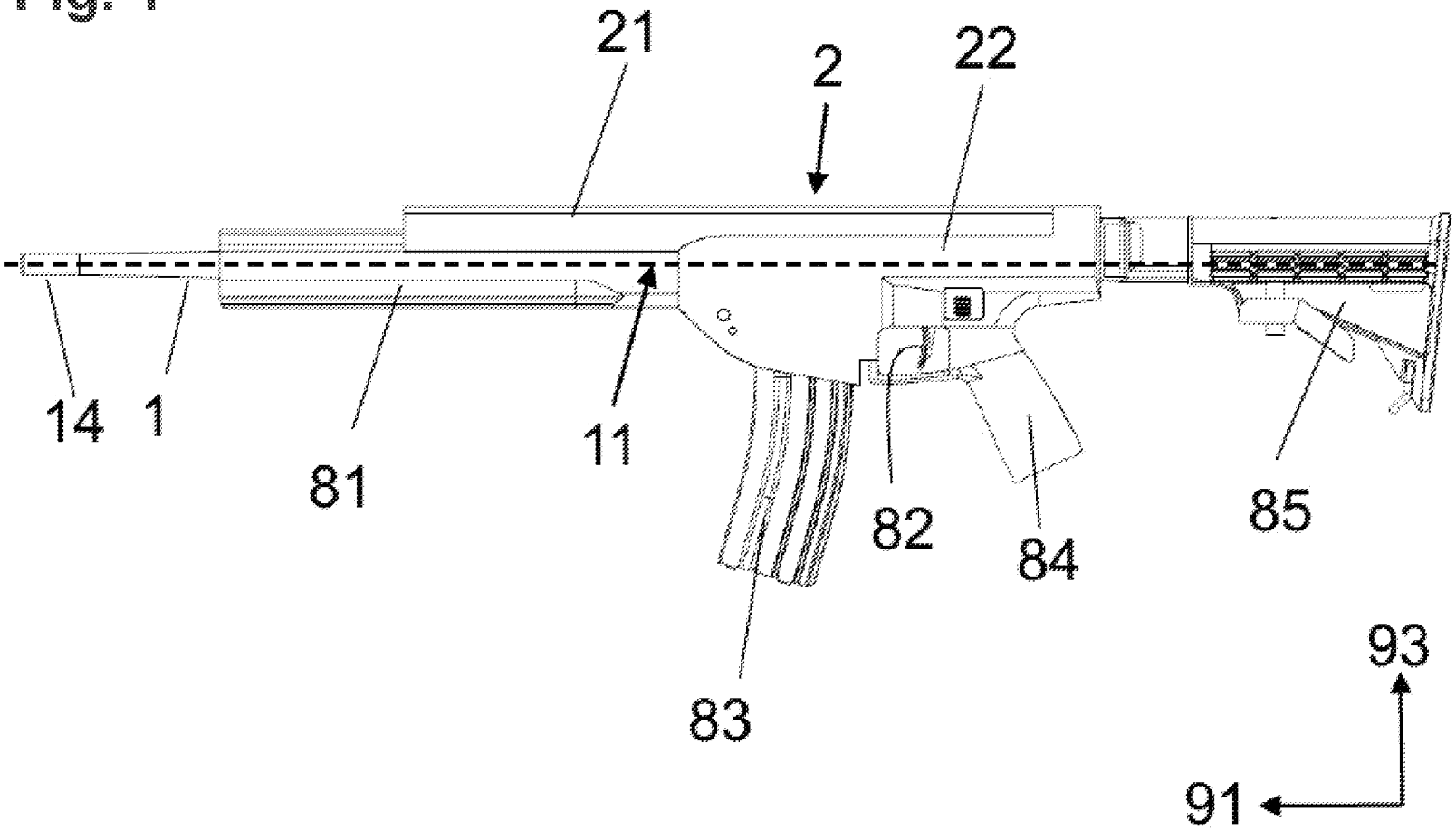
Fig. 1 PRIOR ART
FIG. 1 is a simplified illustration of a firearm according to the prior art.

As used herein, the terms left, right, up, down, front and back in the following always refer to the firearm from the point of view of the firearm when it is held ready to fire. The weapon has, going through the barrel axis and oriented vertically, a weapon center plane, which cum grano salis, forms a plane of symmetry.

In the present disclosure and the claims, the terms "front," "rear," "above," "below" and so on are used in the generally accepted form and with reference to the object in its usual use position. This means that, for the firearm, the muzzle of the barrel is "at the front," that the breech is moved "rearward" by the explosive gas, etc. Transverse to a direction substantially means a direction rotated by 90°.

According to the present disclosure, these goals are achieved by a barrel unit that consists at least of the barrel and the barrel extension, has a cam beginning on the outer surface at the end of the barrel and extending at least partially around the circumference about the barrel axis. The cam comprises at least two portions, wherein the first portion starts at the end of the barrel and extends parallel to the barrel axis, and the second portion extends in the circumferential direction, and the second portion has a locking surface for bracing a cam lug arranged on the barrel extension. The locking surface and the cam lug (or the surface of the cam lug facing the locking surface) are designed to be complementary to each other. The second portion can be connected directly to the first portion, or a third connecting portion can be provided between them.

After being rotated into the second portion, the cam lug comes to lie in a predefined end position, wherein the cam lug is preloaded in the radial direction in the direction of the barrel axis, and the barrel is fixed in the barrel extension. The predefined end position thus corresponds to a position of the barrel that is ready to fire and is temporarily secured against rotation. The barrel is relatively easy to insert into the barrel extension as a result, and can be rotated into the predefined end position in which the barrel is detachably fixed to the barrel extension due to the bracing of the cam lug against the locking surface.

This advantageous embodiment allows the barrel and the barrel extension to be connected to each other simply by inserting one into the other and rotating them into the predefined end position. In the predefined end position, the barrel can transmit the forces that occur when a shot is fired to the barrel extension, which in turn is fixed to the receiver. Whereas with a threaded connection the alignment in the circumferential direction strongly depends on how far the barrel is screwed into the barrel extension, any deviations in the impact position in the horizontal and/or vertical direction can be minimized in the aforementioned way.

If the impact position is then determined for a specific barrel and the firearm is therefore "sighted in" for a given distance, the predefined end position can be used to position the barrel with repeatable accuracy in the circumferential direction even after the firearm has been dismantled. If necessary, the barrel can be detached from the barrel extension relatively easily by rotation in the opposite direction. No tools are required to connect and disconnect the barrel and the barrel extension.

The preloaded fixation of the cam lug against the locking surface can take place, for example, by preloading a spring of the cam lug. The cam lug can, however, also be made of an elastic material. However, it is also possible to reverse the direction of action and, for example, to design the locking surface (or even the locking surface and the cam lug) as a spring-loaded element.

In a particularly advantageous embodiment, the locking surface is designed as a ramp, when viewed in the barrel direction. When viewed in the barrel direction, the locking surface has a different normal distance from the barrel axis at one end than at the other end. As a result, a stepless transition from the cam to the locking surface can be achieved and the barrel can be easily rotated into a predefined end position. Furthermore, the clamping effect upon rotation can increase in a defined manner with a corresponding design of the shape and/or slope of the ramp, and therefore can be easily perceived by the operator.

In a further advantageous embodiment, the ramp of the locking surface, is designed to rise linearly outward in the radial direction when viewed in the direction of the end of the cam. The locking surface therefore rises linearly in the circumferential direction and outwards, which is advantageous in terms of manufacture.

In another particularly advantageous embodiment, the second portion of the cam, can be curved, and for example, S-shaped, when viewed in the barrel direction, with at least two different curved lines. The clamping effect upon rotation can be specifically preset by a person skilled in the art by means of a measure of this type—for example, as a function of the rotation angle—and can be defined with a variable magnitude, and/or can be optimized for particularly long barrels with corresponding weight.

It is also possible to design the locking surface as a curved surface, for example as a surface that is concave relative to the barrel surface. The clamping effect can be particularly optimized in this way. When designed as a concave surface, the profile of the surface appears curved when viewed in the barrel direction and can, for example, have an inward curvature and/or rise discontinuously outward from the transition area to the first section and/or any third section, up to the end of the locking surface. In this way, it is even possible to design this concave surface in a manner similar to a detent, so that the operator can easily recognize when the predefined end position is reached.

In a further special embodiment, a detent which works together with the cam lug or a detent protrusion of the cam lug is formed on the locking surface. The detent can be designed as a small recess, for example in the center of the locking surface. A corresponding complementary detent protrusion on the cam lug can engage in this detent when the predefined end position is reached, and thus define the end point of the rotation movement. The user can therefore easily recognize when the predefined end position has been reached. The detent can also be designed as a small step at the beginning of the locking surface, which works together with the cam lug. The detent can also be designed as an end catch at the end of the cam.

In another special embodiment, an end catch can be formed on the locking surface. This end catch limits the possible movement of the cam lug in the second portion of the cam in the circumferential direction. This makes it particularly easy for the user to recognize the predefined end position, specifically when the end catch is reached.

It has proven to be particularly advantageous if the first portion and the second portion of the cam are connected to each other by means of a connecting portion, or preferably directly connected. This form of the cam and/or its first portion is particularly easy to manufacture since, for example, only one groove running linearly to the rear, and one groove in the circumferential direction, have to be milled. This is also advantageous when the barrel and the barrel extension are guided into each other, since the barrel and the barrel extension can be inserted straight into each other and rotated, and as such, the predefined end position can be reached. It is incumbent on the person skilled in the art to design the second portion directly adjoining the first portion, or to optionally form the rotation path from the first to the second portion, and thus up to the locking surface, by means of a connecting portion in order to design the optimal position and orientation of the locking surface relative to the first portion, the insertion portion. This can be advantageously exploited, particularly for the optimization of the weight of the barrel and its oscillation behavior when a shot is fired.

In addition, it is particularly advantageous if the second portion of the cam is formed at a right angle to a straight line parallel to the barrel axis. After they have been guided into each other, the barrel and the barrel extension only need to be rotated relative to each other in order to reach the predefined end position. A second portion designed in this way can likewise be manufactured very easily as a linear groove in the circumferential direction, for example by means of milling, and essentially corresponds to an "L-shape" when viewed from above and outside.

Furthermore, a particularly favorable design of the barrel unit can have a first distance between two adjacent barrel lugs which is greater than a second distance between two adjacent barrel lugs. The first distance can essentially correspond to the width of the cam lug. The width of the cam lug must be smaller than the first distance and should be greater than the second distance. The result of this design is that the barrel and the barrel extension can only be inserted into each other in exactly one specific orientation, specifically when the cam lug is aligned with the first distance between two adjacent barrel lugs. If the cam lug and the first distance do not coincide, the cam lug can be brought into overlap with the first distance by simply turning the barrel. Then the barrel can simply be inserted into the first portion of the cam. Ideally, the barrel is inserted with the muzzle pointing vertically upwards, and only needs to be gently gripped above the barrel extension so that, when the cam lug is in the correct position, it slides into the cam by itself due to gravity.

It has proven to be particularly advantageous if the cam lug is arranged in the barrel extension by means of a cam lug retainer. The cam lug can be connected to the cam lug retainer as a unit, that is to say, designed as a separate "sub-assembly", which is thus installed in the barrel extension together and at the same time. This is advantageous in terms of manufacture and handling.

Furthermore, it can be particularly advantageous if the cam lug is formed integrally with the cam lug retainer. This reduces the number of parts, and accordingly the production is simplified and the production costs are reduced. Assembly is quicker, and easy-to-lose parts are avoided. For example, the cam lug can be manufactured integrally with the cam lug retainer, for example as a stamped sheet metal part.

Furthermore, it is particularly advantageous if the cam lug retainer is designed as a spring, particularly preferably as a leaf spring, and preloads the cam lug in this way in a predefined end position against the locking surface. A leaf spring can also be arranged in the barrel extension even if there is only little space; in addition, leaf springs are generally highly resilient and particularly wear-resistant. The spring preload produces a particularly high clamping effect in the predefined end position, which is particularly advantageous when the firearm is operated.

In a further, particularly favorable embodiment, the cam lug retainer can be connected in the working position to the barrel extension in a self-clamping and detachable manner. Tight tolerances between the cam lug retainer and the barrel extension produce the self-clamping effect, which allows a connection without connecting elements such as screws, etc., and if necessary the cam lug retainer can be released from the barrel extension and exchanged. For example, small lateral protrusions, which are brought into a corresponding retainer groove in the barrel extension, can be formed on the cam lug retainer. The self-clamping effect is achieved by the close tolerance between the protrusion and the retainer groove.

It is also possible and particularly advantageous that a retainer catch is designed on the cam lug retainer to engage in a notch on the barrel extension in order to secure the cam lug retainer in the working position in the barrel extension. The cam lug retainer is thus secured against axial displacement, and thus against loss from the barrel extension.

A further aspect of the present disclosure is that the barrel has a notch which can work together with an additional anti-rotation element that is designed to be complementary in shape. Such an additional anti-rotation protection of the barrel can be implemented, for example, by means of a bolt positioned transverse to the barrel axis.

It can be particularly advantageous if the additional anti-rotation element is designed as a nose of a tension lever, which is designed to be complementary in shape to the notch. The notch can, for example, be designed as a flat notch in the barrel. The nose can be designed in this case to be flattened in the transverse direction and/or in the barrel direction. In this way, when there is contact between the barrel and the nose, force is transmitted along a line or along a surface, which results in improved anti-rotation protection. This is particularly advantageous in designs in which the barrel extension is already connected to the receiver by means of a clamping mechanism with tension lever.

It is particularly positive if, when in the ready-to-fire position, the nose and the flat are spatially separated from each other by a clearance, the clearance preferably having a width of 0.02 mm to 0.4 mm, and a particularly preferable width of 0.10 mm to 0.20 mm. The clearance ensures that the barrel is mounted so that it can swing freely and is not undesirably clamped by the nose. As such, the anti-rotation protection only works in the event that the barrel is actually rotated.

The barrel unit described herein is suitable for firearms, and therefore also for pistols, but is explained below using the example of a rifle. Further components of the firearm, such as the barrel, cartridge chamber, barrel extension, locking lugs, magazine or buttstock are not explained in more detail here, since they do not concern the core of the disclosed barrel unit, and a person skilled in the art can make modifications simply on the basis of his specialist knowledge, with knowledge of the present disclosure, if necessary or desired at all.

In the figures described below, the barrel direction is indicated by the arrow 91 as forward, the normal direction is indicated by the arrow 93 as upwards, and the transverse direction is indicated by the arrow 92 as left.

FIG. 1 schematically illustrates a firearm, which can comprise a barrel 1 with a barrel axis 11 and muzzle 14, a receiver 2 with an upper receiver part 21 and a lower receiver part 22, a handguard 81, a trigger 82, a magazine 83, a grip 84 and a buttstock 85.

Figure 2:
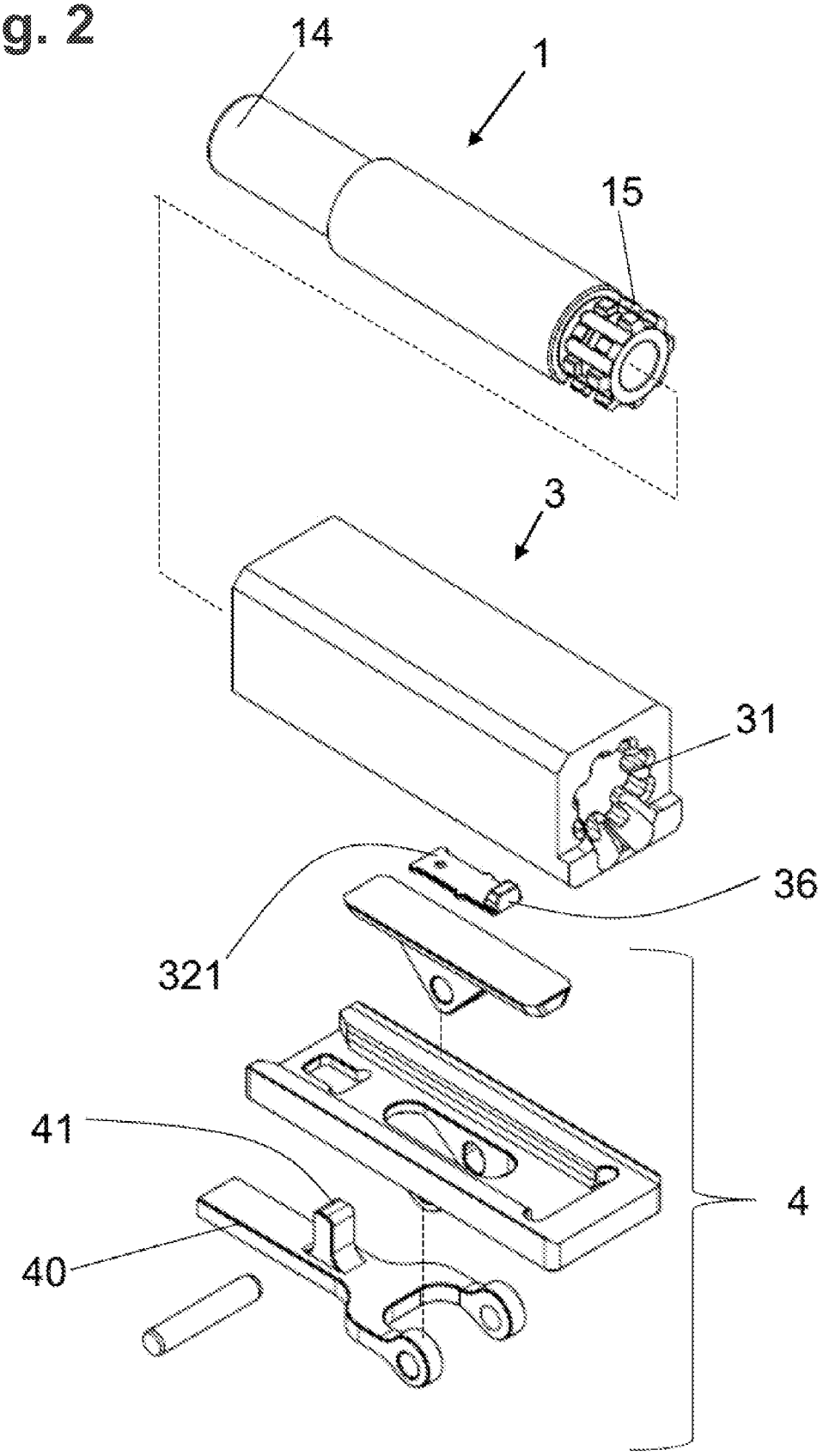
FIG. 2 is an exploded view of an exemplary barrel unit according to the present disclosure.

FIG. 2 depicts a preferred embodiment of the barrel unit according to the present disclosure, in an exploded view, with a muzzle 14 being formed on the barrel 1 and barrel lugs 15 being formed on the barrel 1. Locking lugs 31 which can work together with a bolt are formed on the barrel extension 3, at the first end. The cam lug retainer 321 with the cam lug 36 can be connected to the barrel extension 3. Furthermore, the barrel unit can be fixed to the receiver 2 by means of a clamping assembly 4 having a tension lever 40 and a nose 41.

Figure 3:
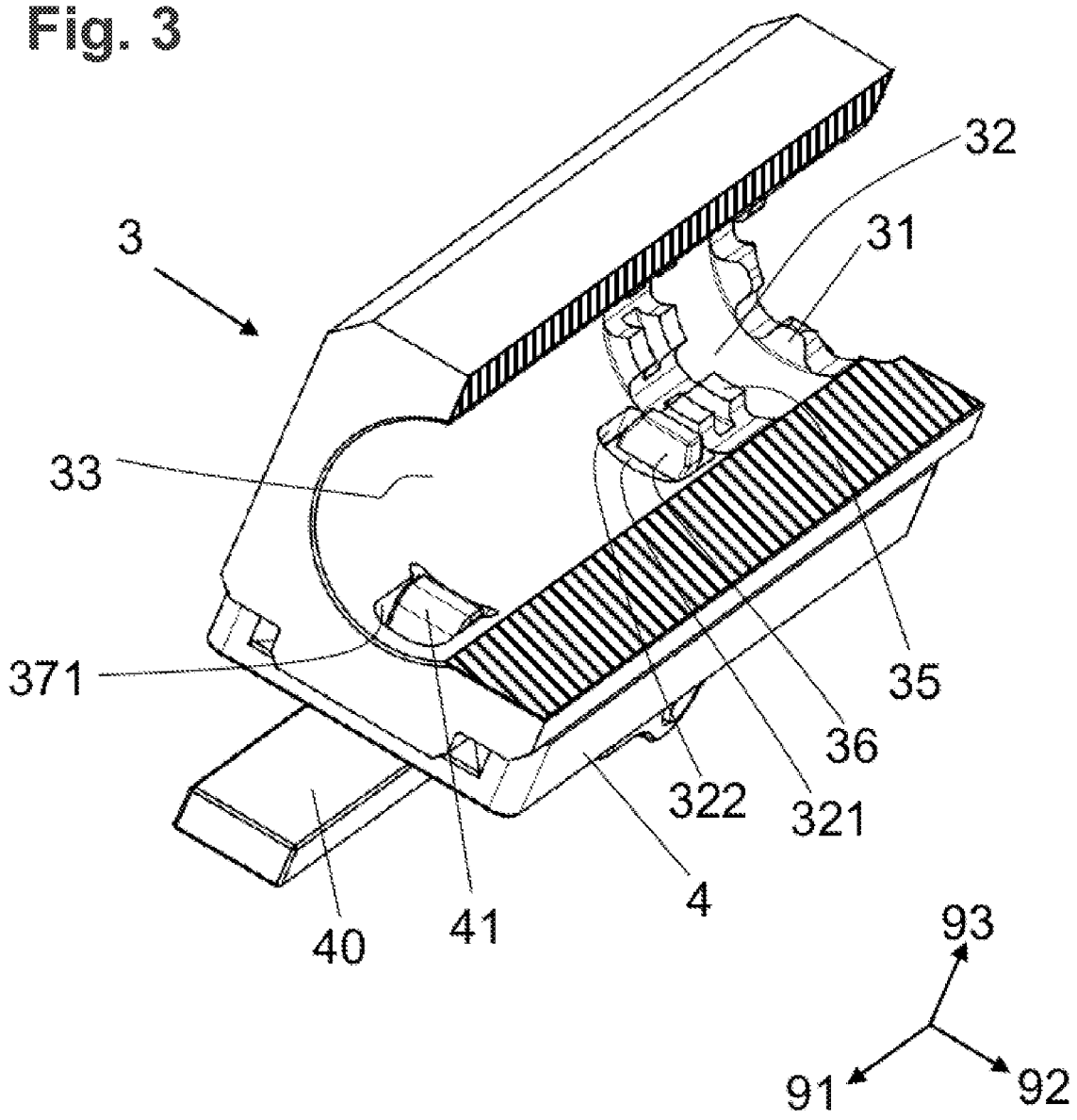
FIG. 3 is a partially cutaway 3-D illustration of an exemplary barrel extension according to the present disclosure.

FIG. 3 is a partially cutaway 3D view of a barrel extension 3 according to the disclosure which, as an elongated body, has a substantially cylindrical opening formed along the longitudinal axis, which can receive the barrel 1 and the end of the bolt of a firearm. The cylindrical opening extends from a first end of the barrel extension 3 to a second end, and comprises a barrel receptacle 33 which extends from the second end in the direction of the first end and adjoins a locking space 32.

Inwardly extending locking lugs 31 corresponding to the prior art, and a locking space 32 behind them, extending in the direction of the second end, are formed in the cylindrical opening on the first end of the barrel extension 3. These can work together with a bolt (not shown), for example a rotating bolt and its bolt end.

Furthermore, barrel locking lugs 35 which extend inward are formed on the barrel receptacle 33, and are arranged closer to the second end of the barrel extension 3 than the locking lugs 31. Corresponding to the prior art, barrel locking lugs 35 can work together with barrel lugs 15 of a barrel 1, of complementary shape, and in this way strongly couple the barrel 1 and the barrel extension 3 to each other in the axial direction.

Furthermore, a cam lug 36 extending inward into the barrel receptacle 33 is formed on the barrel extension 3, and can be arranged closer to the second end than the barrel locking lugs 35. The cam lug 36 is preferably designed as a separate part, or is formed on a separate part, and is spring-loaded. In a preferred and illustrated embodiment, the cam lug 36 is arranged on a cam lug retainer 321 or is formed integrally with it. The cam lug 36 with the cam lug retainer 321 is arranged in a retainer receptacle 322 of the barrel extension 3, for example. The cam lug 36 can preferably be spring-preloaded, for example by the cam lug retainer 321 being designed as a leaf spring. Other alternative designs are also possible. The cam lug 36 can be designed as a spring-loaded pressure piece or as a bolt with a compression spring, or as an elastic element. It is also conceivable to arrange the cam lug retainer 321 in the barrel extension 3 with a spring load.

FIG. 3 also shows a clamping assembly 4 with a tension lever 40 and a nose 41 situated thereon—in the closed state. The barrel unit comprising the barrel 1 and the barrel extension 3 can preferably be fixed to the receiver 2, typically, the upper receiver part 21, by means of a clamping assembly 4. In the clamped state (if the firearm is assembled, this also corresponds to the ready-to-fire state), the tension lever 40 is oriented towards the front, and the nose 41 extends through a recess 371 of the barrel extension 3 and partially protrudes into the barrel receptacle 33.

However, it is also conceivable to connect the barrel unit according to the invention to the receiver 2, for example by means of a barrel nut or thread.

Figure 4A:
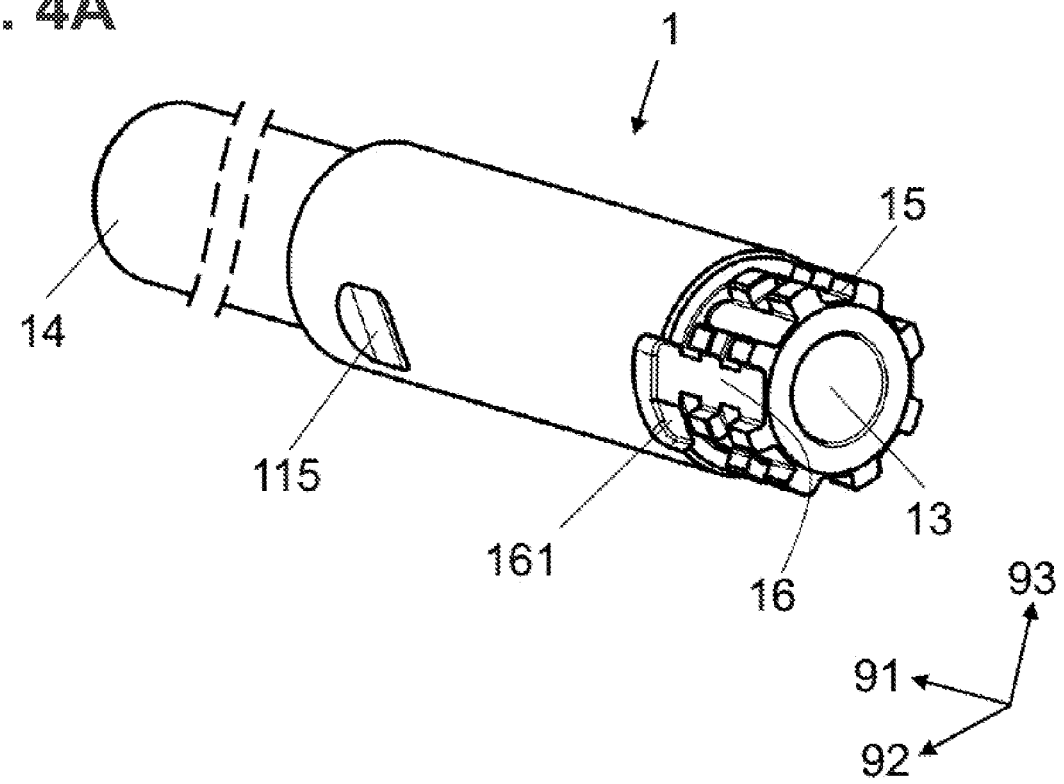
FIGS. 4A and 4B are views of an exemplary barrel as a 3-D illustration and in plan view, respectively.
Figure 4B:
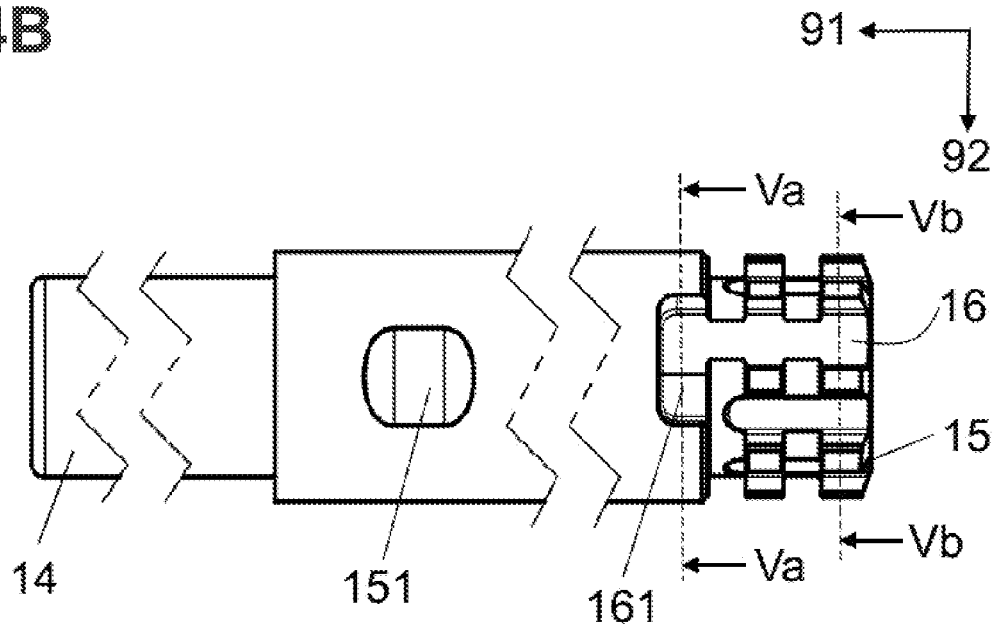

FIGS. 4A and 4B show an exemplary firearm barrel 1 according to the present disclosure, comprising the muzzle 14, a cartridge chamber 13 running along the barrel axis 11, and barrel lugs 15 which are formed on the end of the barrel 1 and can work together with barrel locking lugs 35 of the barrel extension 3. Furthermore, a cam 16 is shown, starting at the end of the barrel 1, which has a first portion which runs substantially parallel to the barrel axis 11 and along the barrel surface in the direction of the muzzle 14, and which passes through the barrel lugs 15. The cam 16 furthermore has, on its end which is remote from the end of the barrel 1, a second portion which is oriented in the circumferential direction and thus normal to the barrel axis 11. The first portion and the second portion can be connected to each other, preferably directly, or can also be connected via a third section (connecting section), which is not shown in detail. A locking surface 161, which ends at the end of the cam 16, is formed on the second portion.

A flat notch 115 formed on the barrel 1 can also be seen in FIG. 4A. A more detailed description of this, and the interaction with a tension lever 40, is described in FIG. 5A.

FIG. 4B shows two sectional planes, IVa and IVb. The corresponding cross-sections are shown in FIGS. 5A and 5B.

Figure 5A:
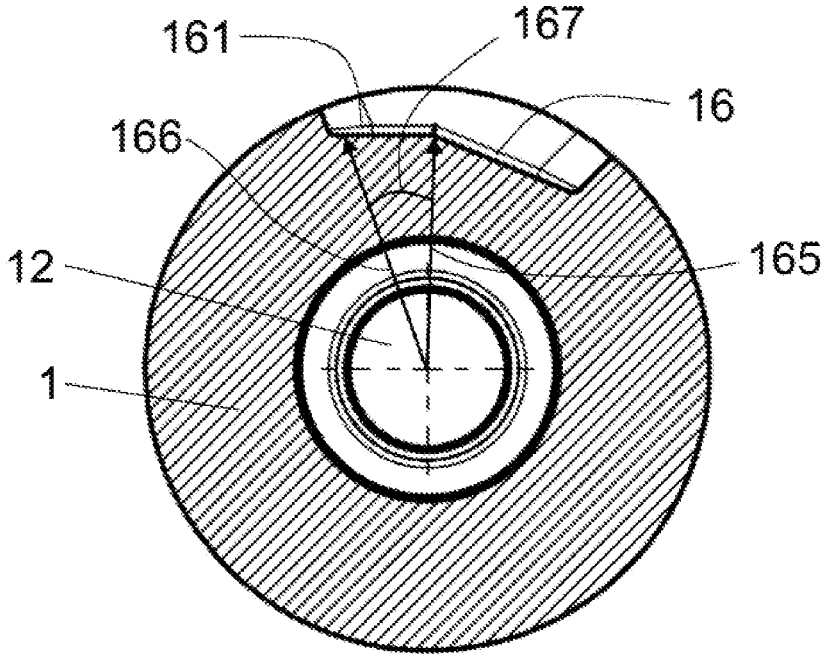
FIGS. 5A and 5B are cross-sections of the barrel of FIG. 4B.
Figure 5B:
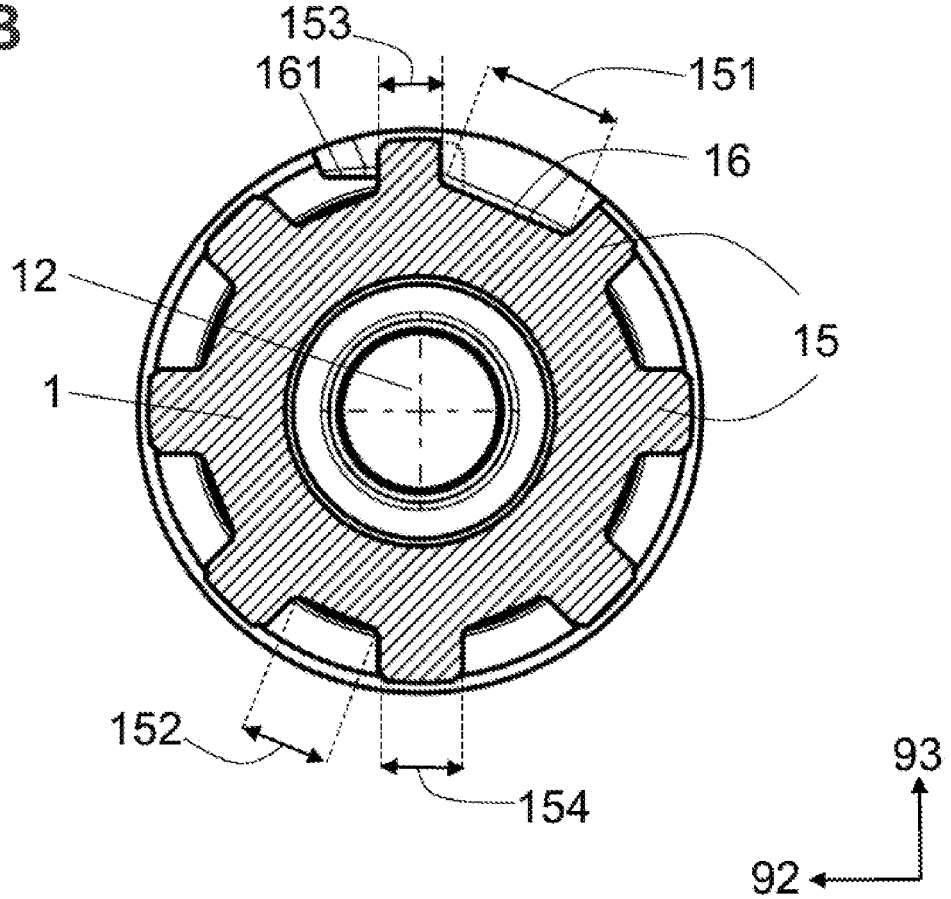

FIG. 5A shows the barrel 1 with the barrel bore 12 and the cam 16 with its first portion, as well as, on the second portion of the cam 16, the locking surface 161, which in a predefined end position works together with the cam lug 36 of complementary shape, and/or in a predefined end position works together with the surface of the cam lug 36 facing the locking surface 161, and detachably fixes the barrel 1 to the barrel extension 3. In the illustration shown, the locking surface 161 is designed as a ramp, preferably a flat ramp, which is parallel to the barrel axis 11. The slope of the locking surface 161 can be described by the ratio of the first normal distance 165 to the second normal distance 166 along the barrel axis 11, and the angle $\alpha$ 167 formed by the first and second normal distances 165, 166 with respect to each other, wherein the first normal distance 165 corresponds to the shortest distance from the locking surface 161 to the barrel axis 11, and the second normal distance 166 corresponds to the longest distance. The locking surface 161 is designed to rise linearly outward in the direction of the end of the cam 16—that is to say, it has a uniformly linear slope.

The locking surface 161 can, however, be designed in the shape of a curve when viewed in the normal barrel direction 91. Alternatively, locking surfaces curved in two dimensions are also possible. For example, the slope and/or shape of the locking surface 161 when viewed in the normal barrel direction 91 can be progressive or concave, degressive or convex, or S-shaped, etc.

Furthermore, the locking surface 161 can have a detent to lock the cam lug 36. This detent can, for example, be arranged in the center of the locking surface 161. The cam lug 36 can optionally have a corresponding detent protrusion, wherein the cam lug 36 and/or the detent protrusion are designed to be complementary in shape to the detent. The locking surface 161 can additionally have an end catch on its end (at the end of the cam 16), which limits the movement of the cam lug 36 in the second portion of the cam 16, as can be seen very clearly in FIGS. 4 and 5. It is also possible that the locking surface 161 as a whole is designed as a detent for the cam lug 36, which is designed with a complementary shape.

The first portion of the cam 16 is preferably designed as a surface parallel to the barrel axis 11. The second portion of the cam 16 preferably directly adjoins the first portion. The second portion is preferably designed in such a manner that its projection in the normal direction 93 to the barrel axis 11 is at a right angle to the barrel axis 11.

FIG. 5B shows the cross-section through the barrel lugs 15. It can be clearly seen that the barrel lugs 15 (as well as the correspondingly designed barrel locking lugs 35 of the barrel extension 3) are arranged uniformly around the circumference of the barrel 1. In the selected illustration, an exemplary embodiment is shown with barrel lugs 15 which are essentially symmetrically arranged when viewed in the normal barrel direction 93. Only two barrel lugs 15, which are adjacent to each other, have a first width 153 which is less than the second width 154 of all other barrel lugs 15. The first distance 151 between these two adjacent barrel lugs is likewise greater than the second distance 152 between all the other barrel lugs 15. According to the present disclosure, the width of the cam lug 36 substantially corresponds to the first distance 151.

The arrangement can be described in the most easily imagined form in such a way that, with a uniform, i.e. symmetrical, distribution of equally-wide barrel lugs 15, with the second width 154 (and always with the same second distance 152), material is removed from the inside of two adjacent barrel lugs 15. As a result, the width of the two adjacent barrel lugs 15 is reduced to the first width 153. The distance in between increases to the first distance 151. This (imaginary) material removal is indicated by a dotted line on the barrel lug at the 12 o'clock position.

As shown, in a preferred embodiment, eight barrel lugs 15 are formed at the end of the barrel 1 in each of two rows positioned one behind the other (and accordingly, two rows of eight barrel locking lugs 35 are formed in the barrel extension 3); the barrel lugs 15 and the barrel locking lugs 35 are preferably the same width. The disclosed barrel unit can, however, also be carried out with a different, lesser or greater, number of barrel lugs 15 and corresponding barrel locking lugs 35. In particular, the widths of the barrel lugs 15 can be the same and, in accordance with the above-described embodiment, the first and second distances 151, 152 can be achieved by a corresponding arrangement of the barrel lugs 15 in the circumferential direction.

To couple the barrel 1 with the barrel extension 3, the barrel 1 is pushed into the barrel receptacle 33 of the barrel extension 3 with the end of the barrel 1 first, and the cam lug 36 is made to overlap with the first distance 151 by rotating it. The barrel 1 can now be moved further into the barrel extension 3, guided by the cam lug 36 in the cam 16. When the cam lug 36 is at the end of the first portion of the cam 16, the cam lug 36 can be braced against the locking surface 161 by rotating the barrel 1, and the predefined end position is thus reached. In the predefined end position, when viewed in the axial direction, the barrel lugs 15 and the barrel locking lugs 35 overlap in order to transfer the forces that occur when a shot is fired from the barrel 1 to the barrel extension 3 and subsequently to the receiver 2 of the firearm. In the predefined end position, the barrel 1 is detachably fixed to the barrel extension 3, that is, coupled.

Figure 6A:
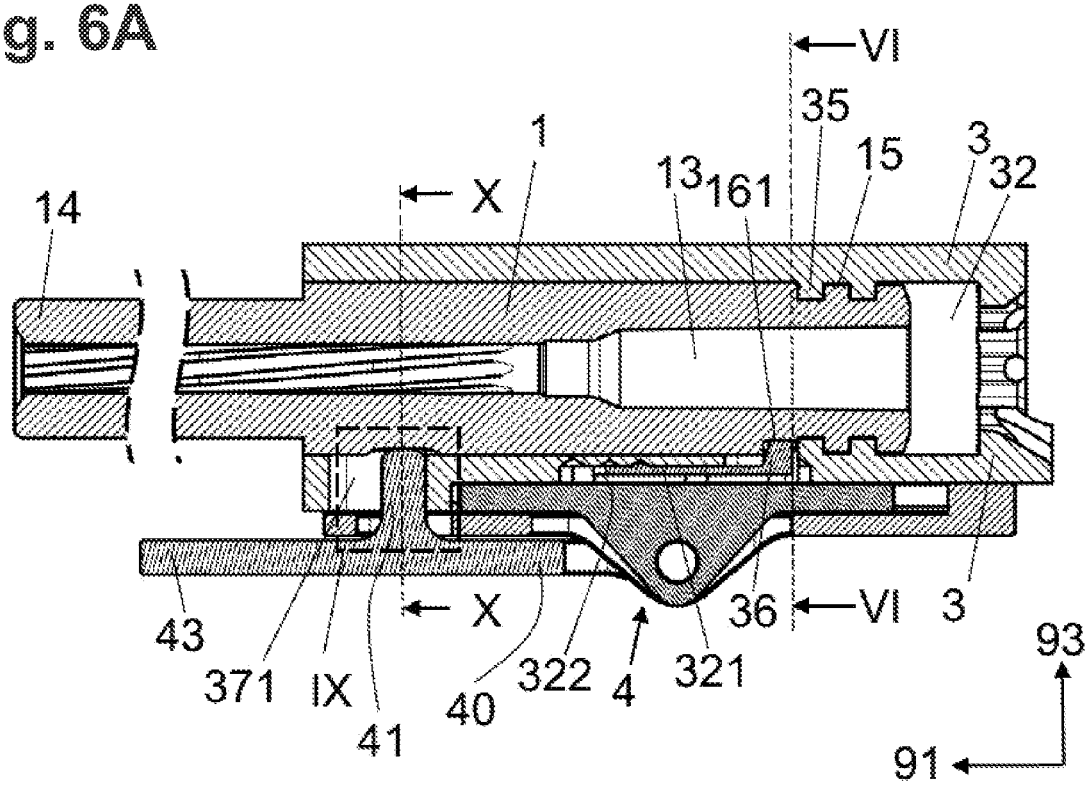
FIGS. 6A and 6B are a longitudinal section of the exemplary barrel with the barrel extension, taken along the weapon center plane, and a corresponding cross-section view, respectively.

FIG. 6A shows a longitudinal section of the barrel unit according to the present disclosure, with a clamping assembly 4 along the weapon center plane, wherein the barrel 1 is in the barrel receptacle 33 of the barrel extension 3 in a predefined end position. The barrel lugs 15 and the barrel locking lugs 35 overlap in the axial direction; a cartridge can be pushed into the cartridge chamber 13 via the locking space 32. The cam lug 36 formed on a cam lug retainer 321 is braced against the locking surface 161. The cam lug retainer 321 is preferably designed as a leaf spring and is arranged in a retainer receptacle 322.

Figure 9:
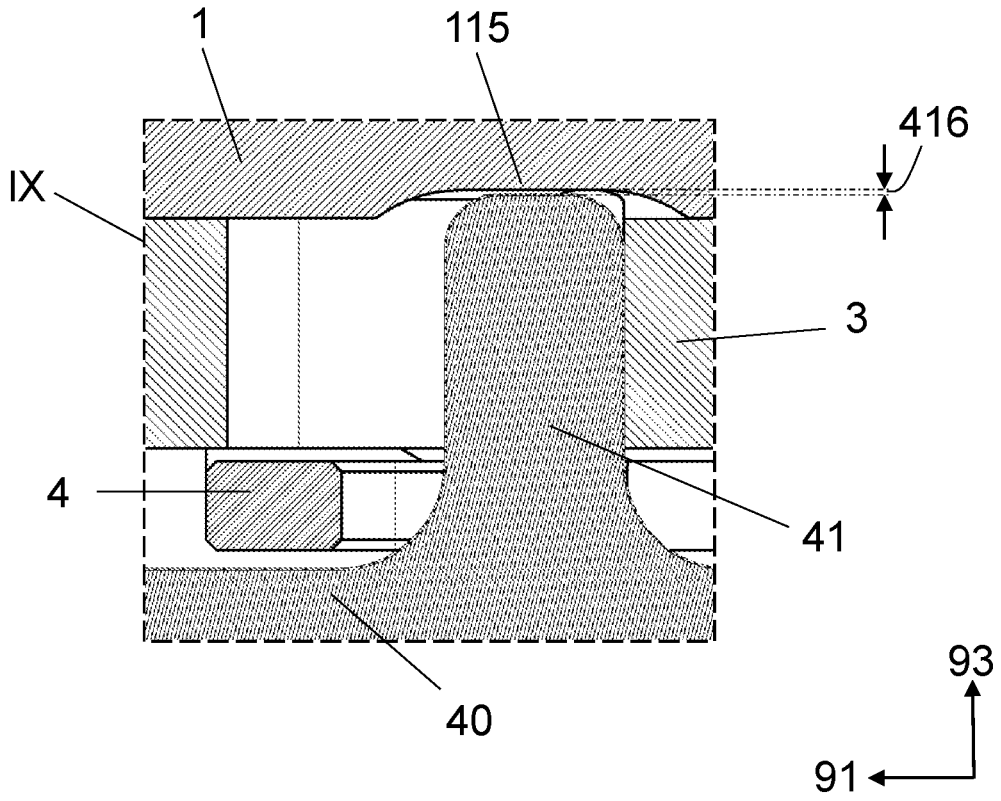
FIG. 9 is a detailed view of a nose, corresponding to a longitudinal section of FIG. 6A.

A clamping assembly 4 with a tension lever 40 and a grip 43 can detachably fix the barrel unit to a receiver 2 (not shown), and is in the ready-to-fire state. The nose 41 engages through the recess 371. The associated detailed view, labeled as IX, is shown in FIG. 9. The corresponding cross-section according to the section plane X-X is shown in FIG. 10. The cross-section corresponding to the section plane VI-VI is shown in FIG. 6B.

Figure 6B:
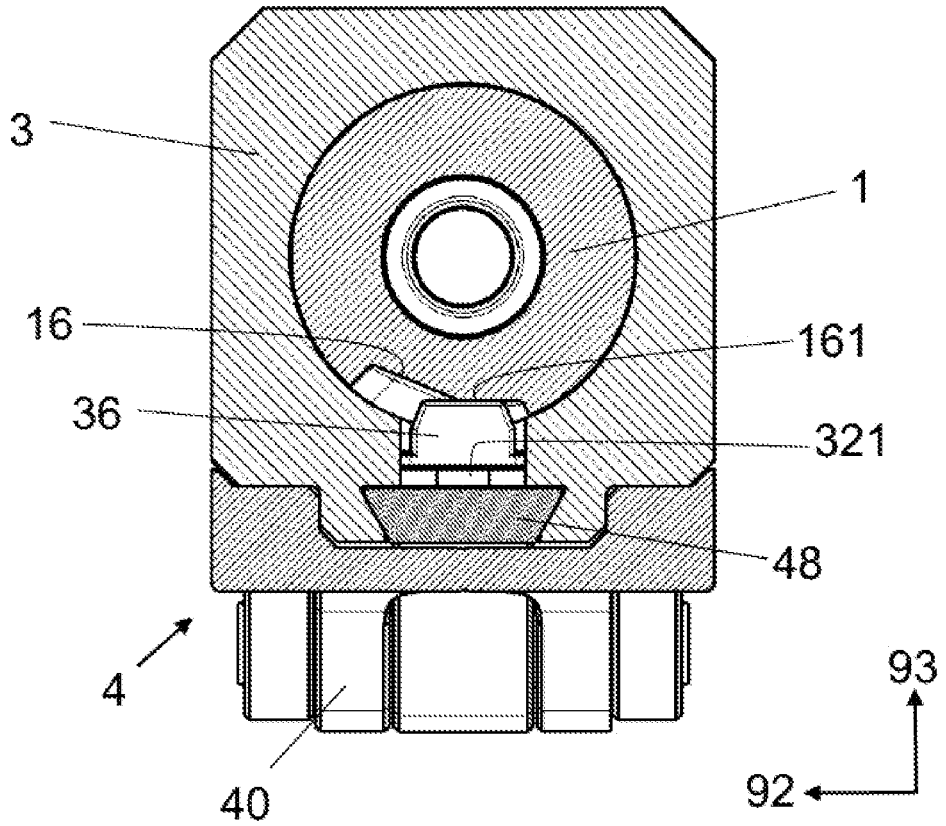

In complement to FIG. 6A, FIG. 6B shows the barrel unit with the clamping assembly 4, in a predefined end position, in the cross-section along the section plane VI-VI from FIG. 6A. The clamping assembly 4 comprises tension levers 40 and a clamping element 48. The cam lug 36 is spring-loaded upward by the cam lug retainer 321, which is designed as a leaf spring, and presses against the locking surface 161. In the illustration shown, the coupling can be released by rotating the barrel 1 counterclockwise. The clamping surface 161 and the cam lug 36 (and/or the surface of the cam lug 36 facing the locking surface 161) are designed to be complementary in shape to each other, and preferably parallel. It can be clearly seen that upon rotation beyond the predefined end position (clockwise), the barrel 1 automatically rotates back into the predefined end position because of the radial spring preload, that is, it positions itself (with repeatable accuracy).

Figure 7A:
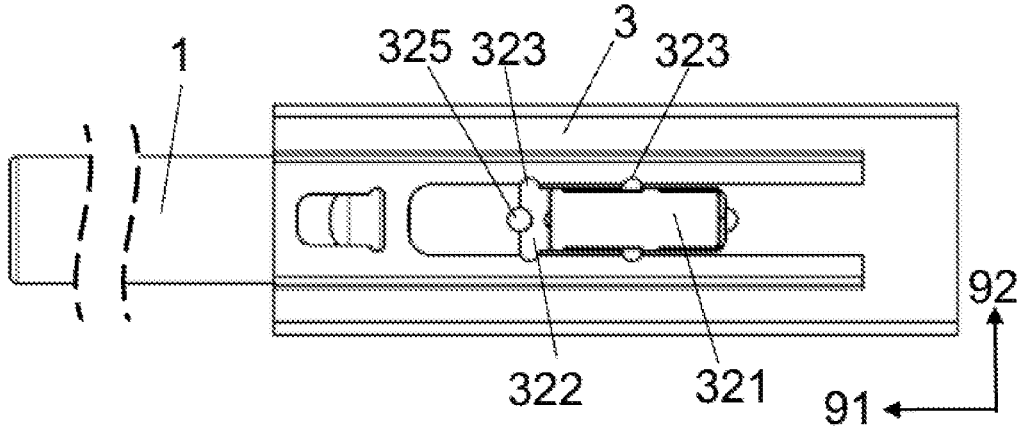
FIGS. 7A to 7C depict an exemplary barrel extension with a cam lug retainer, shown in a plan view and in two sectional views, respectively.

FIG. 7A shows the barrel extension 3 with the cam lug retainer 321 in the working position, in a view from below. The cam lug retainer 321 has four retainer protrusions 324 which are designed to be substantially complementary in shape to retainer guides 323 of the retainer receptacle 322. The cam lug retainer 321 can accordingly be placed in the retainer receptacle 322 and pushed backwards into its working position, opposite the normal barrel direction 91.

Figure 7B:
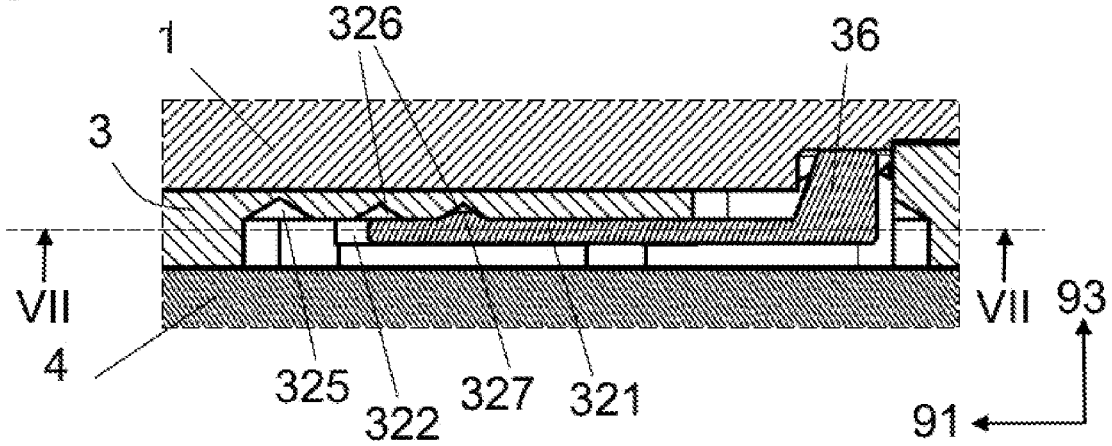
Figure 7C:
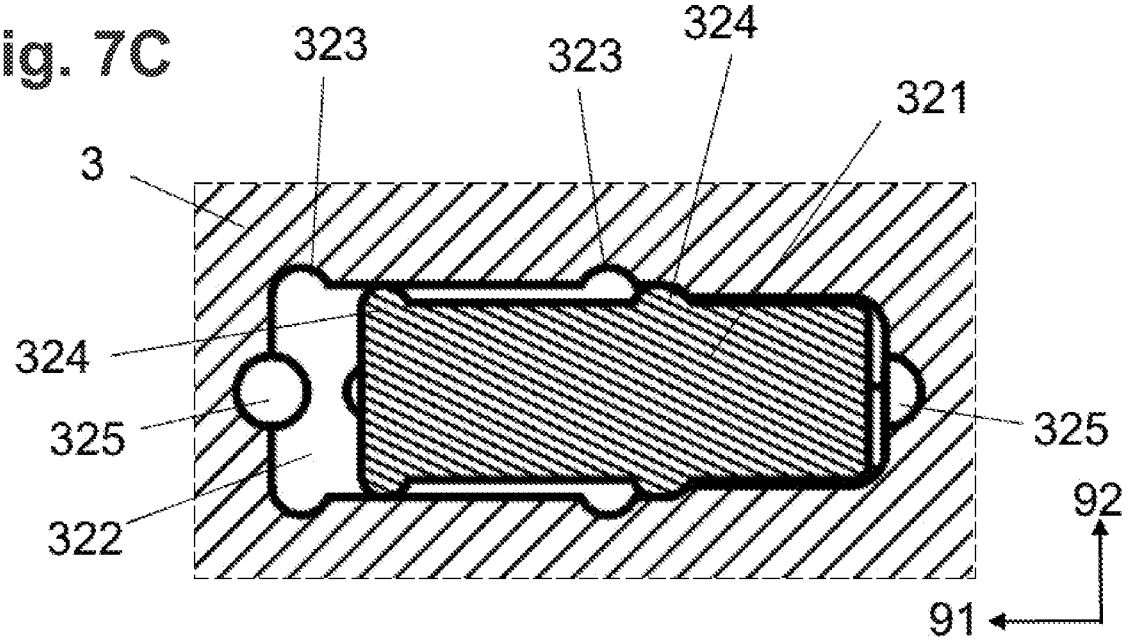
Figure 8:
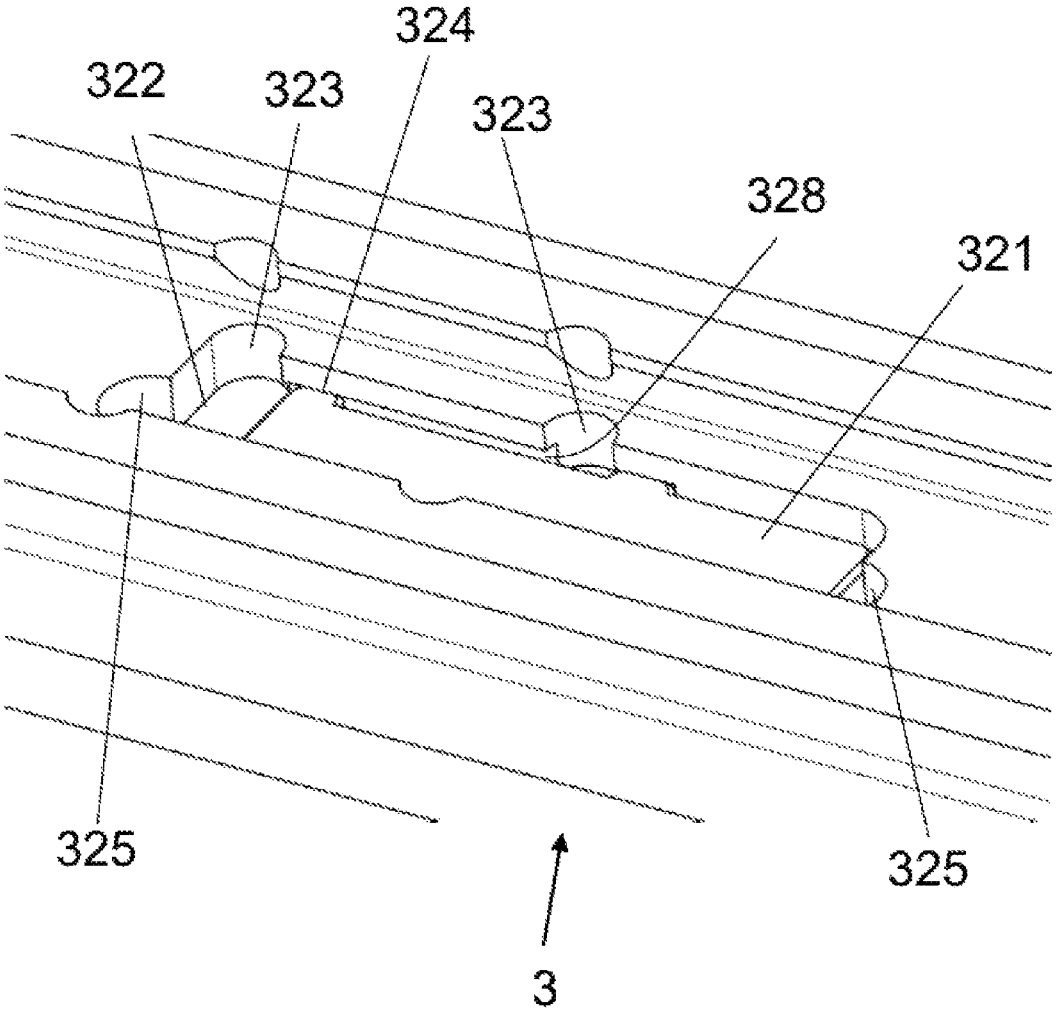
FIG. 8 is a detailed view of an exemplary cam lug retainer installed in a barrel extension, according to the present disclosure.

FIGS. 7B, 7C, and 8 together show that retainer grooves 328 are formed in the barrel extension 3, wherein the retainer protrusions 324 are guided in the retainer grooves 328 with a very tight tolerance when the cam lug retainer 321 is in the working position. This means that the cam lug retainer 321 is connected to the barrel extension 3 in a self-clamping manner. For axial locking and loss prevention in the working position, the cam lug retainer 321 can have a retainer catch 327 which engages in a notch 326. Temporary intermediate locking in the assembly position at a second notch 326 can also take place according to the same principle.

For a better understanding of the mounting of the cam lug retainer 321, attention is directed to an oblique view in FIG. 8, in which the retainer groove 328, the retainer guides 323 and the retainer protrusions 324 can be seen very clearly.

Furthermore, it is possible to form a flat notch 115 on the barrel 1 which works together with an additional anti-rotation element which is designed to be complementary in shape. For example, it is possible to implement such an additional anti-rotation protection (for the barrel 1 and the barrel extension 3) by means of a bolt which is arranged in the barrel extension 3 or in the receiver 2 transverse to the barrel axis 11, and which engages in the flat notch 115.

Figure 10A:
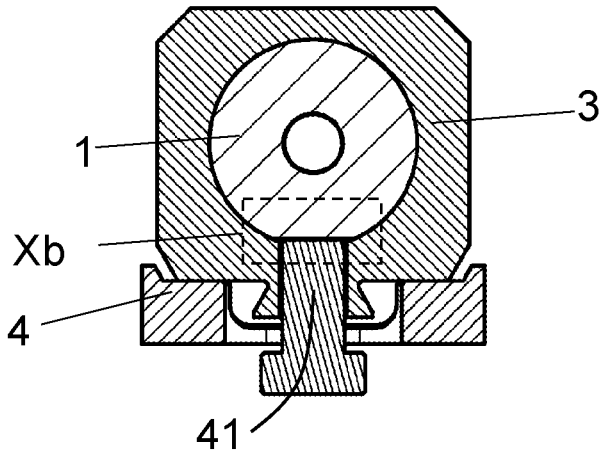
FIGS. 10A and 10B are a cross-section view and a detailed view of a longitudinal section of FIG. 6A.
Figure 10B:
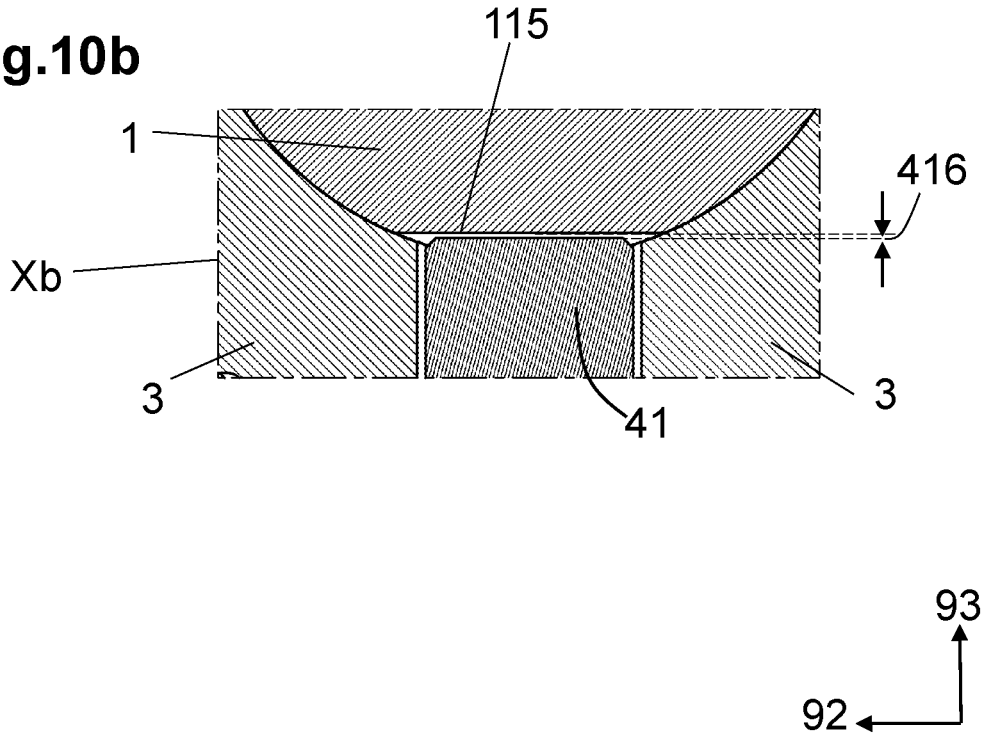

Another preferred embodiment is described below in FIGS. 9 and 10. FIG. 9 shows a detail view of IX from FIG. 6A; FIG. 10A furthermore shows the cross-section taken along the section plane X-X in FIG. 6A, and FIG. 10B shows the corresponding detail view of Xb.

FIGS. 9 and 10, when viewed together, show the interaction of a preferred, additional anti-rotation element, specifically a nose 41, with a flat notch 115 of the barrel 1, which is preferably designed as a flat notch 115. In the embodiment shown, the barrel unit with the barrel 1 and the barrel extension 3 is in a predefined end position and is fixed to a receiver 2 (not shown) with a clamping assembly 4. The clamping assembly 4 comprises a tension lever 40 which, in the clamped and thus ready-to-fire state, is oriented substantially parallel to the barrel axis 11. A nose 41 formed on the tension lever 40 extends upwards in the normal barrel direction 93, starting at the tension lever 40, as viewed in the closed position, engages through the recess 371 of the barrel extension 3, and protrudes into the barrel receptacle 33.

The barrel 1 has a flat notch 115 on a side facing the nose 41 in the ready-to-fire state. Depending on the shape of the nose 41, other shape-complementary recesses can also be formed. In the ready-to-fire position, the barrel 1 should be spaced from the tip of the nose 41 by a clearance 416 in the region of the flat notch 115; see also FIG. 10B. With this arrangement, the barrel 1 is additionally secured against rotation in the barrel extension 3, but is not undesirably braced. When the tension lever 40 is open (that is, oriented downward), the nose 41 is out of engagement with the flat notch 115 of the barrel 1, and accordingly the barrel 1 can be rotated out of the predefined end position and released from the barrel extension 3.

Due to the shape-complementary design of the flat notch 115 of the barrel 1, the tension lever 40 can only be closed when the barrel 1 is aligned in a predetermined position in the barrel extension 3. A kind of "end position verification" of the barrel 1 can thus be achieved in a simple manner. It has proven to be advantageous if the clearance 416—if provided—is only a few hundredths of a millimeter, preferably 0.02 to 0.40 mm, particularly preferably from 0.10 to 0.20, as can also be clearly seen in the detail view in FIG. 10B of Xb in FIG. 10A.

Figure 11:
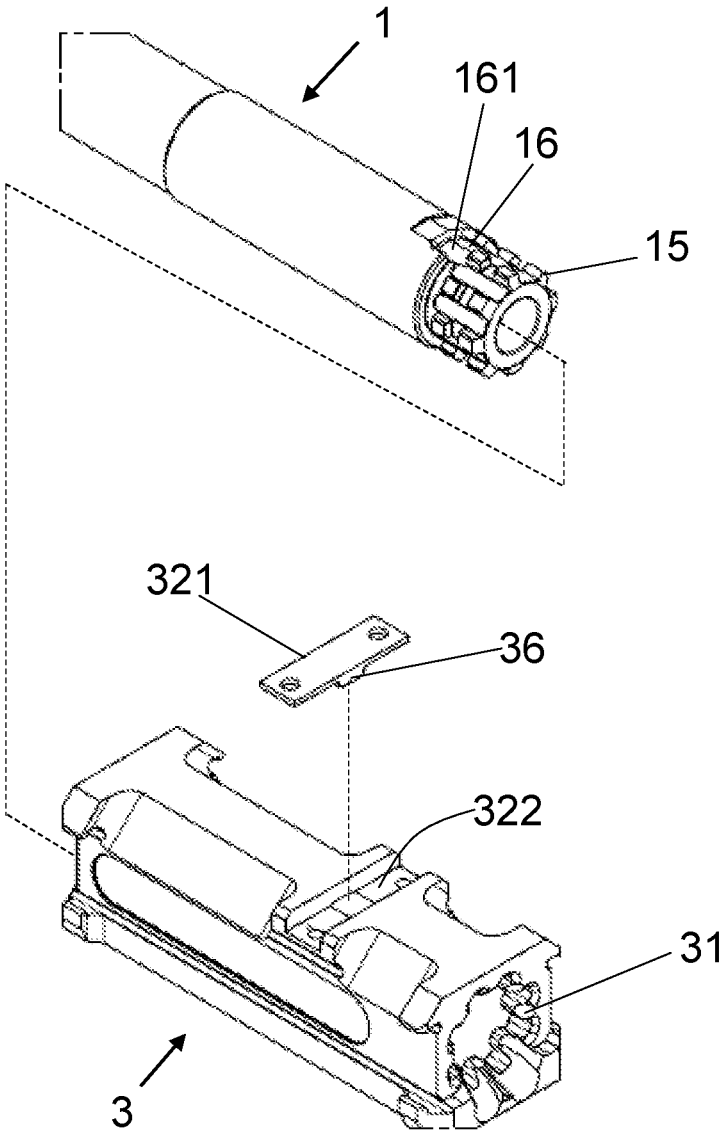
FIG. 11 is an exploded view of an alternative embodiment of a barrel unit according to the present disclosure.

FIG. 11 is a further preferred embodiment of the barrel unit according to the present disclosure, in an exploded view. The cam lug retainer 321 is designed as a resilient leaf and is arranged transverse to the bore axis 11, at top when viewed in the normal barrel direction 91. The cam lug 36 is formed centrally on the cam lug retainer 321. The cam lug retainer 321 can be connected to the barrel extension 3 by means of screws, for example. This illustration serves to clarify that the position and design of the cam lug 36 and/or the cam lug retainer 321 on the barrel extension 3 can be optimized by a person skilled in the art in a relatively simple manner in accordance with the above teaching.

The present disclosure is not limited to the illustrated and described exemplary embodiments, but can be modified and configured in various ways. In particular, the shapes and sectional shapes shown of the named weapon parts, in particular the barrel, cam, barrel lugs, barrel extension, barrel locking lugs, cam lug, cam lug retainer, tension lever, distances, widths, recesses, etc. can be adapted to the specific basic data, and the lengths and the positions relative to each other, and with regard to the receiver, are easily adaptable for a person skilled in the art with knowledge of the disclosed barrel unit. In particular, equivalent designs are obvious with knowledge of the disclosed barrel unit and can be carried out without further ado by a person skilled in the art. In particular, the named embodiments are mutatis mutandis to be applied to embodiments with the opposite direction of action of the locking surface and cam lug, and/or biasing of both elements.

It should also be noted that in the description and the claims, terms such as the "lower region" of an object, refer to the lower half and in particular the lower quarter of the overall height; "lowermost region" refers to the lowermost quarter and in particular an even smaller part, while "central region" refers to the central third of the overall height. For the terms "width" and/or "length," this applies mutatis mutandis. All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for indications such as "parallel" or "normal," this means ±10°. If there are terms such as "substantially constant" etc., what is meant is the technical possibility of deviation which the person skilled in the art takes as a basis and not the mathematical one. For example, a "substantially L-shaped cross-section" comprises two elongated surfaces, which merge at one end into the end of the other surface, and whose longitudinal extension is arranged at an angle of 45° to 120° to each other.

All given quantities and percentages, in particular those relating to the limitation of the disclosure, insofar as they do not relate to specific examples, are understood to have a tolerance of ±10%; accordingly, for example: 11% means 9.9% to 12.1%. With terms such as "a solvent," the word "a" is not to be considered to represent a singular numeral, but rather is to be considered an indefinite article or pronoun, unless the context indicates otherwise.

Unless otherwise stated, the term "combination" and/or "combinations," means all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the disclosed barrel unit in the claims without necessarily including the other details of the particular embodiment or of the particular example.

LIST OF REFERENCE SIGNS

| | | | |
|---|---|---|---|
| 1 | Barrel | 3 | Barrel extension |
| 11 | Barrel axis | 31 | Locking lugs |
| 12 | Barrel bore | 32 | Locking space |
| 13 | Cartridge chamber | 33 | Barrel receptacle |
| 14 | Muzzle | 35 | Barrel locking lugs |
| 115 | Flat notch | 36 | Control cam (cam lug) |
| 15 | Barrel lugs | 321 | Cam lug retainer |
| 151 | First distance | 322 | Retainer receptacle |
| 152 | Second distance | 323 | Retainer guide |
| 153 | First width | 324 | Retainer protrusion |
| 154 | Second width | 325 | Mounting hole |
| 16 | Cam | 326 | Indentation (notch) |
| 161 | Locking surface | 327 | Retainer catch |
| 165 | First normal distance | 328 | Retainer groove |
| 166 | Second normal distance | 371 | Recess |
| 167 | Angle α | 4 | Clamping assembly |
| 2 | Receiver | 40 | Tension lever |
| 21 | Upper receiver | 41 | Nose |
| 22 | Lower receiver | 416 | Gap (clearance) |
| | | 43 | Grip |
| 81 | Handguard | 48 | Clamping element |
| 82 | Trigger | | |
| 83 | Magazine | 91 | Barrel direction (front) |
| 84 | Grip | 92 | Transferee direction (left) |
| 85 | Buttstock | 93 | Normal direction (up) |

The invention claimed is:

1. A barrel unit for a firearm, comprising:

a barrel having a barrel axis, a muzzle, a barrel end opposite the muzzle, and at least two barrel lugs formed on the barrel end;

a barrel extension having a barrel receptacle, the barrel extension having a first end and a second end;

a plurality of inwardly extending locking lugs formed on the first end of the barrel extension, the locking lugs being configured to work together with a bolt;

a plurality of inwardly extending barrel locking lugs formed on the barrel extension, the barrel locking lugs being formed closer to the second end than the inwardly extending locking lugs;

wherein the barrel has a cam on an outer surface that is configured to cooperate with a cam lug arranged on the barrel extension, the cam having a first portion and a second portion, the first portion being formed beginning at the end of the barrel and extending parallel to the barrel axis, and the second portion being at least partially formed in a circumferential direction around the barrel axis;

and wherein the second portion has a locking surface that is complementary in shape to the cam lug, such that the cam lug and/or the locking surface are configured to be preloaded against each other in a radial direction to fix the barrel in a predefined end position.

2. The barrel unit according to claim 1, wherein the locking surface, when viewed in the barrel direction, is designed as a ramp.

3. The barrel unit according to claim 2, wherein the ramp of the locking surface rises linearly outward in the radial direction in a direction toward the end of the cam.

4. The barrel unit according to claim 1, wherein the locking surface, when viewed in the barrel direction, is curved.

5. The barrel unit according to claim 1, wherein the locking surface is a curved surface.

6. The barrel unit according to claim 1, wherein the locking surface is a curved surface that is concave relative to a barrel surface.

7. The barrel unit according to claim 1, wherein the locking surface defines a detent configured to work cooperatively with the cam lug or with a detent protrusion of the cam lug.

8. The barrel unit according to claim 1, further comprising an end catch formed on the locking surface, the end catch limiting the movement of the cam lug in the circumferential direction in the second portion of the cam.

9. The barrel unit according to claim 1, wherein the first portion and the second portion of the cam are connected to each other by a connecting portion.

10. The barrel unit according to claim 1, wherein the first portion and the second portion of the cam are connected directly to each other.

11. The barrel unit according to claim 1, wherein the second portion of the cam is formed at a right angle to a straight line parallel to the barrel axis.

12. The barrel unit according to claim 1, wherein a first distance between two adjacent barrel lugs is greater than a second distance between any other two adjacent barrel lugs.

13. The barrel unit according to claim 1, wherein the cam lug is arranged on a cam lug retainer in the barrel extension.

14. The barrel unit according to claim 13, characterized in that the cam lug is formed integrally with the cam lug retainer.

15. The barrel unit according to claim 13, wherein the cam lug retainer includes a spring.

16. The barrel unit according to claim 13, wherein the cam lug retainer includes a leaf spring.

17. The barrel unit according to claim 13, wherein the cam lug retainer is detachably connected to the barrel extension in a self-clamping manner when in a working position.

18. The barrel unit according to claim 13, further comprising a retainer catch formed on the cam lug retainer that is configured to engage in a notch defined by the barrel extension in order to secure the cam lug retainer in the barrel extension in a working position.

19. The barrel unit according to claim 1, wherein the barrel defines a notch that is configured cooperate with an additional anti-rotation element having a shape complementary to the notch.

20. The barrel unit according to claim 19, wherein the notch defined by the barrel is a flat notch that is complementary in shape to a nose of a tension lever.

21. The barrel unit according to claim 20, wherein when in a ready-to-fire position the nose of the tension lever and the flat notch are spatially separated by a clearance of 0.02 mm to 0.4 mm.

22. The barrel unit according to claim 20, wherein when in a ready-to-fire position the nose of the tension lever and the flat notch are spatially separated by a clearance of 0.10 mm to 0.20 mm.

* * * * *